US009121556B1

(12) United States Patent
McDermott

(10) Patent No.: US 9,121,556 B1
(45) Date of Patent: Sep. 1, 2015

(54) LIGHT EMITTING DIODE (LED) LIGHTING DEVICE

(71) Applicant: Kevin McDermott, Rockledge, FL (US)

(72) Inventor: Kevin McDermott, Rockledge, FL (US)

( * ) Notice: Subject to any disclaimer, the term of this patent is extended or adjusted under 35 U.S.C. 154(b) by 0 days.

(21) Appl. No.: 14/242,154

(22) Filed: Apr. 1, 2014

(51) Int. Cl.
*F21L 4/00* (2006.01)

(52) U.S. Cl.
CPC ..... *F21L 4/00* (2013.01)

(58) Field of Classification Search
CPC ..... F21L 4/00; F21L 4/005
USPC ..... 362/190, 191, 202, 206
See application file for complete search history.

(56) References Cited

U.S. PATENT DOCUMENTS

2007/0109775 A1* 5/2007 Chen ..... 362/187
2011/0019395 A1* 1/2011 Malkoff ..... 362/202

* cited by examiner

*Primary Examiner* — David V Bruce
(74) *Attorney, Agent, or Firm* — Lowe Hauptman & Ham, LLP

(57) ABSTRACT

A light emitting diode (LED) lighting device including a circuit configured to energize a surface mount LED lamp having an LED heat sink with a source of power. The LED lighting device further includes a printed circuit board having a first side, a second side and an opening extending from the first side to the second side. The surface mount LED lamp attached to the first side with the LED heat sink located adjacent to the opening on the first side. The LED lighting device further includes a fixture configured to hold the printed circuit board and position a metallic heat sink having a protrusion on the second side of the printed circuit board with the protrusion passing through the opening and contacting the LED heat sink.

20 Claims, 5 Drawing Sheets

LL
11
2D
20
10
8
HEO
9
2
B1P, B1PP
1, F
B1
B1N
B2P, B2PP
B2
B2N
5
HEC

LIGHT EMITTING DIODE (LED) LIGHTING DEVICE

FIELD

The present description relates to a light emitting diode (LED) lighting device having a heat sink and a surface mount LED lamp.

BACKGROUND

Light emitting diode (LED) light sources are susceptible to damage by excessive heat buildup. Surface mount LED light sources are energized at high power levels which increases an amount of heat generated. In some approaches, surface mount LED light sources include a heat sink located such that when the LED is mounted on a printed circuit (PC) board the heat sink contacts the PC board permitting terminal energy to flow from the LED to reduce a temperature of the LED. The inclusion of the heat sink increases the mass of the PC board. A PC board is usually small which reduces an amount of heat energy that the PC board can absorb. In addition, the PC boards typically have high thermal resistance reducing an ability to absorb heat energy. Finally, although the LED heat sink is facing the PC board, the LED heat sink is not in physical contact due to variations in soldering or dimensions, in some instances.

DETAILED DESCRIPTION

Figure 1:
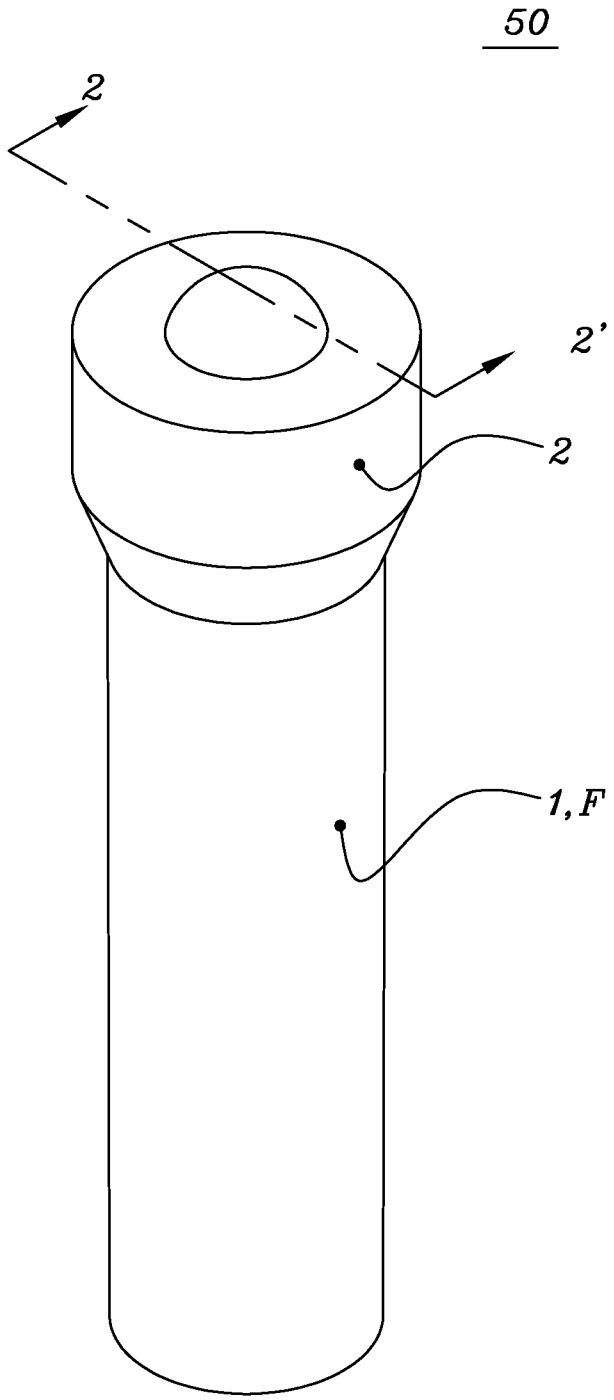
FIG. 1 is a perspective view of alighting device according to some embodiments.

FIG. 1 is a perspective view of a lighting device 50 according to some embodiments. Lighting device 50 includes a fixture F having a housing 1 and a retainer 2.

Figure 2:
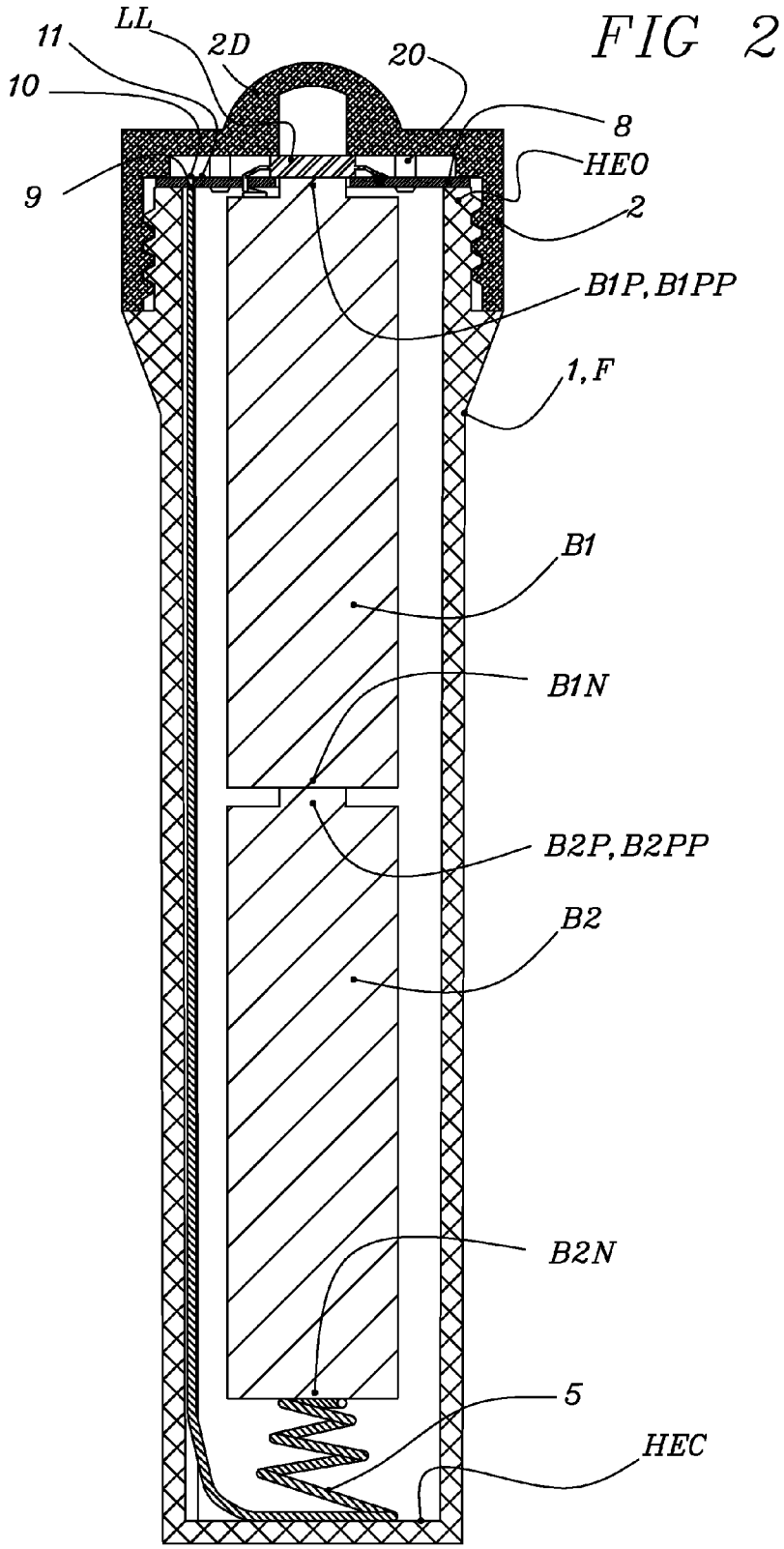
FIG. 2 is a cross-sectional view taken across line 2-2' of FIG. 1 according to some embodiments.

FIG. 2 is a cross sectional view taken across line 2-2' of FIG. 1 according to some embodiments. Housing 1 has a tubular configuration including a housing end closed HEC and a housing end open HEO with a battery one B1 and a battery two B2 installed. In some embodiments, the two batteries B1 and B2 are AA size batteries. In some embodiments, lighting device 50 includes one or more batteries or employs a variety of battery configurations. Although the drawings and description regarding lighting device 50 includes two discrete batteries as a source of power for the LED, one of ordinary skill in the art would recognize that the term battery should be interpreted to mean either a single battery or a plurality of batteries to energize an LED lamp LL. Retainer 2 includes a threaded internal surface for engaging a threaded external surface of housing 1.

Figure 3:
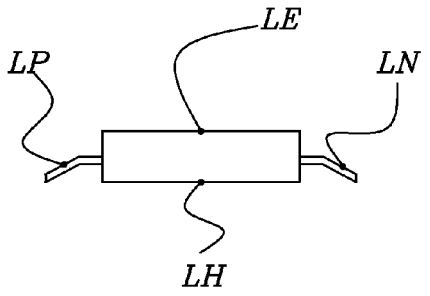
FIG. 3 is a side view of a light emitting diode (LED) lamp according to some embodiments.

FIG. 3 is a side view of LED lamp LL according to some embodiments. LED lamp LL includes an LED positive terminal LP, an LED negative terminal LN, an LED emitter surface LE and an LED heat sink LH. In some embodiments, LED lamp LL is part number LR W5SN-JYKY-1Z manufactured by OSRAM™ or any other suitable LED lamp.

Figure 4:
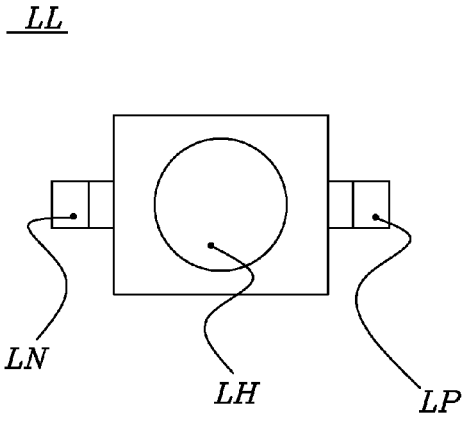
FIG. 4 is a bottom view of an LED lamp according to some embodiments.

FIG. 4 is a bottom view of LED lamp LL according to some embodiments. LED heat sink LH is between LED positive terminal LP and LED negative terminal LN.

Figure 5:
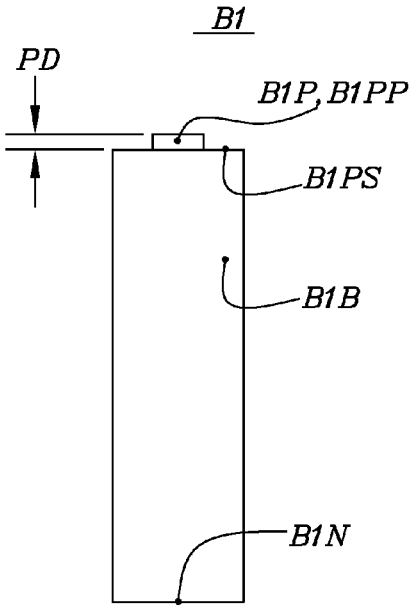
FIG. 5 is a side view of a battery according to some embodiments.

FIG. 5 is a side view of battery one B1 according to some embodiments. Battery one B1 is a AA battery with a metallic shell capable of functioning as a metallic heat sink. Battery one B1 includes a positive end having a positive terminal B1P including a battery one positive protrusion B1PP and a battery one positive surface B1PS which are a single metal component and electrically connected. Either battery one positive protrusion B1PP or battery one positive surface B1PS is able to be used as a positive connection of battery one B1. Battery one positive projection B1PP extends a protrusion distance PD from a battery one body B1B. Battery one B1 also includes a negative end having a negative terminal B1N. Battery two B2 similarly includes a positive end having a positive terminal B2P including a battery two positive protrusion B2PP and a negative end having a negative terminal B2N (FIG. 2). In some embodiments, battery one B1 and battery two B2 are placed in a series connection with negative terminals facing housing end closed HEC and with positive terminals facing housing end opened HEO of housing 1. A spring 5 is a compression spring placed between battery two negative terminal B2N and housing end closed HEC. Spring 5 is additionally configured to contact and exert a force on battery two negative terminal B2N pushing battery two B2 towards LED lamp LL. Spring 5 extends along an inner longitudinal wall of housing 1 to contact a bottom side 8B (FIG. 6) of a printed circuit board 8 at a lower contact pad 9 and plated thru a switch hole 10.

Figure 6:
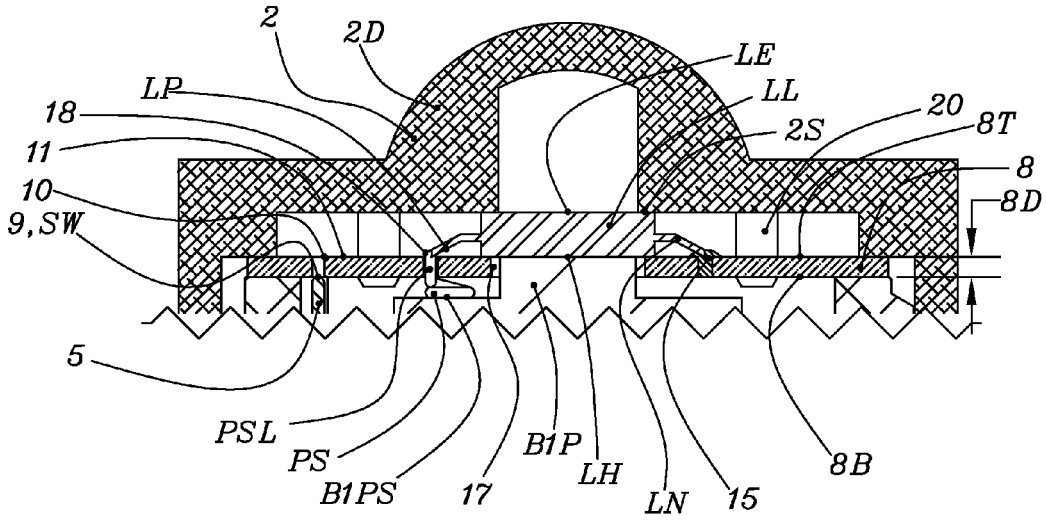
FIG. 6 is an enlarged view of a top portion of FIG. 2.

FIG. 6 is an enlarged view of a top portion of FIG. 2. Spring 5 contacts printed circuit board 8 and conducts electricity from negative terminal B2N of battery two B2 to lower contact pad 9 and plated thru switch hole 10. Since switch thru hole 10 is plated, the switch thru hole conducts electricity to a top side 8T of printed circuit board 8 where the electricity is conducted by an upper surface pad 11 to LED negative terminal LN. Upper surface pad 11 intersects LED negative terminal LN and is soldered at that junction to help assure electrical connection. In some embodiments, printed circuit board 8 also includes a plated thru negative hole 15 which is located at or adjacent to LED negative terminal LN. Plated thru negative hole 15 substantially increases the structure which anchors and secures LED lamp LL to printed circuit board 8 as solder fills plated thru negative hole 15 and connects to LED negative terminal LN. This additional structure helps to assure that LED lamp LL is not displaced from printed circuit board 8.

Battery one positive protrusion B1PP passes through hole 17 in printed circuit board 8 and contacts LED heat sink LH of LED lamp LL. Spring 5 creates a force pushing battery one B1 and battery two B2 towards LED lamp LL. However, the battery one B1 and battery two B2 have limited movement because LED heat sink LH exerts a counter force on the batteries at battery one positive protrusion B1PP. Hence, spring 5 maintains battery one positive protrusion B1PP pressed against LED heat sink LH. This pressed against relationship helps assure and maximize heat transfer from LED lamp LL to battery one B1. In order to maintain a pressed against relationship between LED lamp LL and battery one B1 printed circuit board 8 includes a printed circuit board thickness 8D which is less than projection distance PD (FIG. 5) of battery one B1.

Printed circuit board 8 also includes a plated thru positive hole 18 located under or adjacent to LED positive terminal LP. A positive compression spring PS includes a leg PSL passing through printed circuit board 8 at plated thru positive hole 18. Leg PSL is soldered within plated thru positive hole 18 and also soldered to LED positive terminal LP. Positive compression spring PS extends towards battery one B1 where the positive compression spring contacts battery one positive surface B1PS thereby completing a circuit C (FIG. 9) for energizing LED lamp LL with battery one B1 and battery two B2. In some embodiments, LED lamp LL includes LED heat sink LH electrically connected to LED positive terminal LP and the LED lamp energizing circuit C is completed as battery one positive protrusion B1PP contacts the LED heat sink. In some embodiments, LED lamp LL is part number LR W5SN-JYKY-1Z manufactured by OSRAM™ and includes a heat sink electrically connected to LED positive terminal LP and positive spring PS is not necessary to energize LED lamp LL. Battery one B1 is a source of electrical power, a metallic heat sink and a conductor for energizing circuit C for LED lamp LL. In some embodiments, metallic heat sinks are included which are not the source of electrical power or a conductor of energizing circuit C.

Spring 5 is pushing battery one B1 and battery two B2 against LED lamp LL and the resulting force sufficient to lift a contact pad or a track attaching LED lamp LL to printed circuit board 8 and separate LED lamp LL from printed circuit board 8, in some instances. Plated thru positive hole 18 and plated thru negative hole 15 are each one of several similar plated thru holes which act as anchors for securing respective LED terminals and ultimately LED lamp LL to printed circuit board 8, in some embodiments. Retainer 2 is molded of a transparent plastic and threaded onto housing 1 such that when the retainer is tightened spring 5 at housing end opened HEO makes contact with lower contact pad 9 thereby closing circuit C and energizing LED lamp LL, in some embodiments. Conversely when retainer 2 is loosened the retainer rotates lower contact pad 9 away from a top of spring 5, opens circuit C and de-energizes LED lamp LL. Hence, lower contact pad 9, retainer 2 and spring 5 cooperate to form a switch SW. Therefore, circuit C includes the battery one B1, battery two B2, spring 5, printed circuit board 8, LED lamp LL and switch SW for selectively de-energizing or energizing LED lamp LL. Retainer 2 is additionally contoured to provide a retainer support 2S on a retainer dome 2D to support and deter LED lamp LL from moving away from or being separated from printed circuit board 8 due to the forces developed by spring 5, in some embodiments.

Removing heat from LED lamp LL decreases a temperature of the LED lamp and therefore increases the luminous efficacy of the lamp. The heat which flows into battery one B1, which functions as a metallic heat sink, warms the battery. In cold environments batteries fail to function properly, in some instances. Therefore, warming battery one B1 improves an ability of the battery one to provide energy in cold environments.

Figure 7:
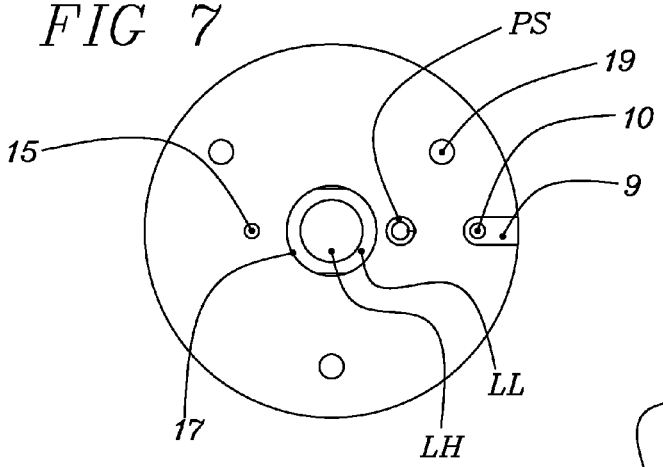
FIG. 7 is a bottom view of a printed circuit board according to some embodiments.
Figure 8:
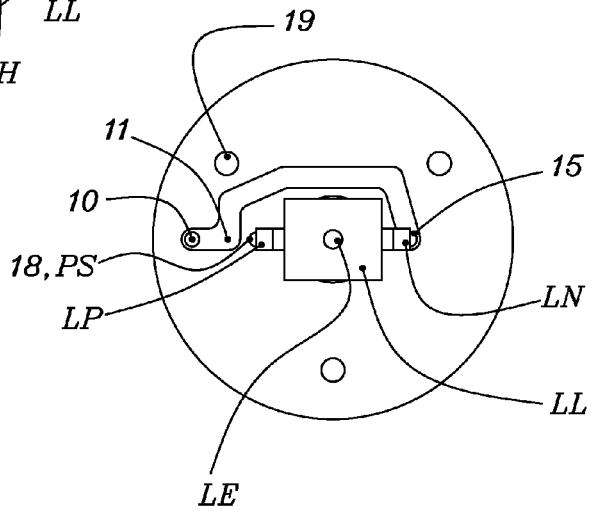
FIG. 8 is a top view of a printed circuit board according to some embodiments.

FIG. 7 is a bottom view of printed circuit board 8 according to some embodiments. FIG. 7 includes printed circuit board mount hole 19 employed to secure printed circuit board 8 to retainer 2. A mount pin 20 (FIG. 6) passes through mount hole 19 and is glued in position to secure printed circuit board 8 to retainer 2. FIG. 8 is a top view of printed circuit board 8 according to some embodiments. Printed circuit board 8 includes LED negative terminal LN of LED lamp LL soldered to upper surface pad 11 and plated thru negative hole 15. Printed circuit board 8 also includes LED positive terminal LP soldered to plated thru positive hole 18 and to positive spring PS.

Figure 9:
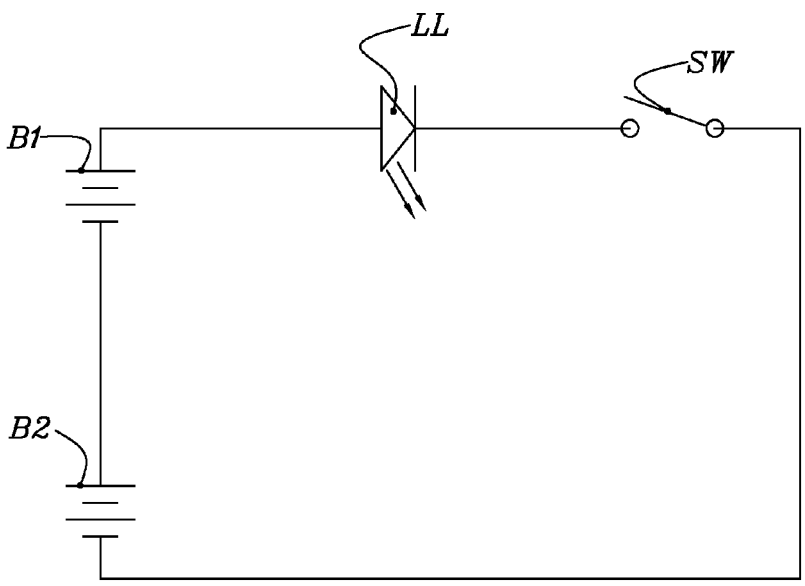
FIG. 9 is a schematic diagram of a circuit for energizing an LED lamp according to some embodiments.

FIG. 9 is a schematic diagram of a circuit C for energizing an LED lamp according to some embodiments.

One aspect of this description relates to a light emitting diode (LED) lighting device including a circuit configured to energize a surface mount LED lamp having an LED heat sink with a source of power. The LED lighting device further includes a printed circuit board having a first side, a second side and an opening extending from said first side to said second side. The surface mount LED lamp attached to said first side with said LED heat sink located adjacent to said opening on said first side. The LED lighting device further includes a fixture configured to hold said printed circuit board and position a metallic heat sink having a protrusion on said second side of said printed circuit board with said protrusion passing through said opening and contacting said LED heat sink.

Another aspect of this description relates to a light emitting diode (LED) lighting device. The LED lighting device includes a circuit configured to energize a surface mount LED lamp having an LED heat sink, wherein the circuit comprises a source of power. The LED lighting device further includes a printed circuit board having a first side, a second side and an opening extending from said first side to said second side. The surface mount LED lamp is attached to said first side, and said LED heat sink is located adjacent to said opening on said first side. The LED lighting device further includes a fixture configured to hold a spring, said printed circuit board, and a metallic heat sink having a protrusion, said metallic heat sink is located on said second side of said printed circuit board with said protrusion passing through said opening, said spring configured to press said protrusion against said LED heat sink.

Still another aspect of this description relates to a light emitting diode (LED) lighting device. The LED lighting device includes a circuit configured to energize a surface mount LED lamp with a battery, said LED having an LED heat sink. The LED lighting device further includes a printed circuit board having a first side, a second side and an opening extending from said first side to said second side. The surface mount LED lamp solder bonded to said first side with said LED heat sink located adjacent to said opening on said first side. The LED lighting device further includes a fixture having a tubular housing comprising a first housing end and a second housing end, wherein said second housing end is a closed end. The battery has a positive terminal having a protrusion and a negative terminal, said battery positioned within said housing with said negative terminal about said second housing end and said positive terminal about said first housing end, said fixture having a retainer for holding said printed circuit board at said first housing end with said battery on said second side and said protrusion passing through said opening and contacting said LED heat sink, said printed circuit board comprising a thickness less than a length of said protrusion. The fixture is configured to hold a spring for pressing said protrusion against said LED heat sink.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A light emitting diode (LED) lighting device comprising:

a circuit configured to energize a surface mount LED lamp having an LED heat sink with a source of power;

a printed circuit board having a first side, a second side and an opening extending from said first side to said second side;

said surface mount LED lamp attached to said first side with said LED heat sink located adjacent to said opening on said first side;

a fixture configured to hold said printed circuit board and position a metallic heat sink having a protrusion on said second side of said printed circuit board with said protrusion passing through said opening and contacting said LED heat sink.

2. The LED lighting device according to claim 1, wherein said fixture comprises a spring configured to press said metallic heat sink against said LED heat sink.

3. The LED lighting device according to claim 1, wherein said fixture comprises an LED lamp support configured to deter movement of said surface mount LED lamp away from said board.

4. The LED lighting device according to claim, 1 wherein said surface mount LED lamp is solder bonded to said printed circuit board at a location on said printed circuit board having thru holes for anchoring said surface mount LED lamp to said printed circuit board.

5. The LED lighting device according to claim 1, wherein said source of power comprises a battery and said battery is said metallic heat sink.

6. The LED lighting device according to claim 1, wherein said source of power comprises a battery, said battery is said metallic heat sink, and said battery comprises a positive terminal and a negative terminal, said positive terminal comprising said protrusion, and said printed circuit board has a thickness less than a length of said protrusion.

7. The LED lighting device according to claim 1, wherein said circuit comprises a switch for selectively energizing or de-energizing said surface mount LED lamp.

8. The LED lighting device according to claim 1, wherein said surface mount LED lamp comprises a negative terminal and a positive terminal, and said LED heat sink is electrically connected to said positive terminal.

9. A light emitting diode (LED) lighting device comprising:

a circuit configured to energize a surface mount LED lamp having an LED heat sink, wherein the circuit comprises a source of power;

a printed circuit board having a first side, a second side and an opening extending from said first side to said second side;

said surface mount LED lamp is attached to said first side, and said LED heat sink is located adjacent to said opening on said first side;

a fixture configured to hold a spring, said printed circuit board, and a metallic heat sink having a protrusion, said metallic heat sink is located on said second side of said printed circuit board with said protrusion passing through said opening, said spring configured to press said protrusion against said LED heat sink.

10. The LED lighting device according to claim 9, wherein said circuit comprises a switch for selectively energizing or de-energizing said surface mount LED lamp.

11. The LED lighting device according to claim 9, wherein said fixture comprises an LED lamp support for deterring movement of said surface mount LED lamp away from said printed circuit board.

12. The LED lighting device according to claim 9, wherein said surface mount LED lamp is solder bonded to said printed circuit board at a location on said printed circuit board having thru holes for anchoring said LED lamp to said printed circuit board.

13. The LED lighting device according to claim 9, wherein said source of power is a battery and said battery is said metallic heat sink.

14. The LED lighting device according to claim 9, wherein said source of power is a battery, said battery is said metallic heat sink, and said battery comprises a positive terminal and a negative terminal, said positive terminal comprising said protrusion, said printed circuit board has a thickness less than a length of said protrusion.

15. The LED lighting device according to claim 9, wherein said LED has a negative terminal and a positive terminal, and said LED heat sink is electrically connected to said positive terminal.

16. A light emitting diode (LED) lighting device comprising:

a circuit configured to energize a surface mount LED lamp with a battery, said LED having an LED heat sink;

a printed circuit board having a first side, a second side and an opening extending from said first side to said second side;

said surface mount LED lamp solder bonded to said first side with said LED heat sink located adjacent to said opening on said first side;

a fixture having a tubular housing comprising a first housing end and a second housing end, wherein said second housing end is a closed end;

said battery has a positive terminal having a protrusion and a negative terminal, said battery positioned within said housing with said negative terminal about said second housing end and said positive terminal about said first housing end, said fixture having a retainer for holding said printed circuit board at said first housing end with said battery on said second side and said protrusion passing through said opening and contacting said LED heat sink, said printed circuit board comprising a thickness less than a length of said protrusion, and;

said fixture is configured to hold a spring for pressing said protrusion against said LED heat sink.

17. The LED lighting device according to claim 16, wherein said circuit comprises a switch for selectively energizing or de-energizing said LED.

18. The LED lighting device according to claim 16, wherein:

said fixture comprises an LED lamp support configured to deter movement of said surface mount LED lamp away from said printed circuit board.

19. The LED lighting device according to claim 16, wherein said surface mount LED lamp comprises a negative terminal and a positive terminal, and said LED heat sink is electrically connected to said positive terminal.

20. The LED lighting device according to claim 16, wherein said surface mount LED lamp at a location on said printed circuit board having thru holes for anchoring said LED lamp to said printed circuit board.

* * * * *